US005259361A

United States Patent [19]

LeStrat et al.

[11] Patent Number: 5,259,361

[45] Date of Patent: Nov. 9, 1993

[54] COOKING ASSEMBLY FOR A COOKER OR A COOKING TOP AND INCLUDING AT LEAST ONE GAS BURNER

[75] Inventors: Georges L. LeStrat, Saint-Martin-Aux-Arbres; Michel Lefebvre, Rouen; Michel Emont, Moulineaux; Bernard Logel, Gundershoffen; Robert Strasser, Drachenbrown; Claude Valentin, Reichshoffen, all of France

[73] Assignee: Butagaz, Neuilly-sur-Seine Cedex, France

[21] Appl. No.: 852,220

[22] PCT Filed: Sep. 26, 1991

[86] PCT No.: PCT/FR91/00752

§ 371 Date: Jun. 1, 1992

§ 102(e) Date: Jun. 1, 1992

[87] PCT Pub. No.: WO92/06334

PCT Pub. Date: Apr. 16, 1992

[30] Foreign Application Priority Data

Oct. 1, 1990 [FR] France ..... 90 12060

[51] Int. Cl.[5] ..... F24C 3/00

[52] U.S. Cl. ..... 126/39 J; 126/39 R; 431/328

[58] Field of Search ..... 431/328; 126/39 H, 39 J, 126/39 N, 39 R

[56] References Cited

U.S. PATENT DOCUMENTS

| | | | |
|---|---|---|---|
| 3,027,936 | 4/1962 | Lamp . | |
| 3,468,298 | 9/1969 | Teague et al. | 431/328 |
| 3,592,180 | 7/1971 | Kweller . | |
| 3,597,135 | 8/1971 | Kweller . | |
| 4,569,328 | 2/1986 | Shukla et al. | 431/328 |
| 4,597,734 | 7/1986 | McCausland et al. | 431/328 |

FOREIGN PATENT DOCUMENTS

| | | | |
|---|---|---|---|
| 187512 | 11/1982 | Japan | 431/328 |
| 1262334 | 2/1972 | United Kingdom . | |
| 2185564 | 7/1987 | United Kingdom . | |
| 9008921 | 8/1990 | World Int. Prop. O. . | |

*Primary Examiner*—Carroll S. Dority

*Attorney, Agent, or Firm*—Jacobson, Price, Holman & Stern

[57] ABSTRACT

The invention relates to a cooking assembly for a cooker or a cooking top, the assembly including a cooking plate (1) and at least one gas burner (100) enabling a receptacle to be heated, said cooking plate including an opening (4) associated with said burner to enable the burner to act directly. According to the invention, at least one of the gas burners (100) is a radiant burner having a metal fiber structure, with its top face (101) being essentially plane and flush with the top surface (P) of the cooking plate (1), said radiant burner (100) being organized so as to close the associated opening (4). The invention is applicable to cooking assemblies for cookers or cooking tops having a cooking plate made of vitroceramic, of molded glass, or of agglomerated inorganic fibers.

12 Claims, 3 Drawing Sheets

FIG. 8
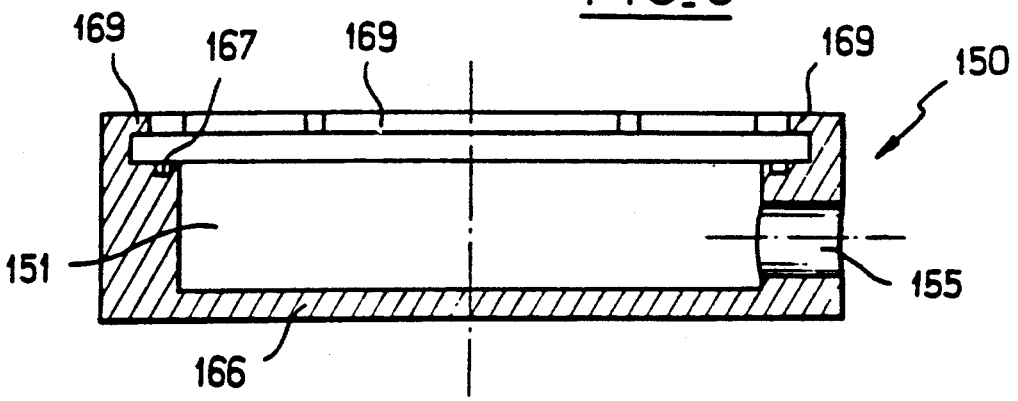
FIG. 9
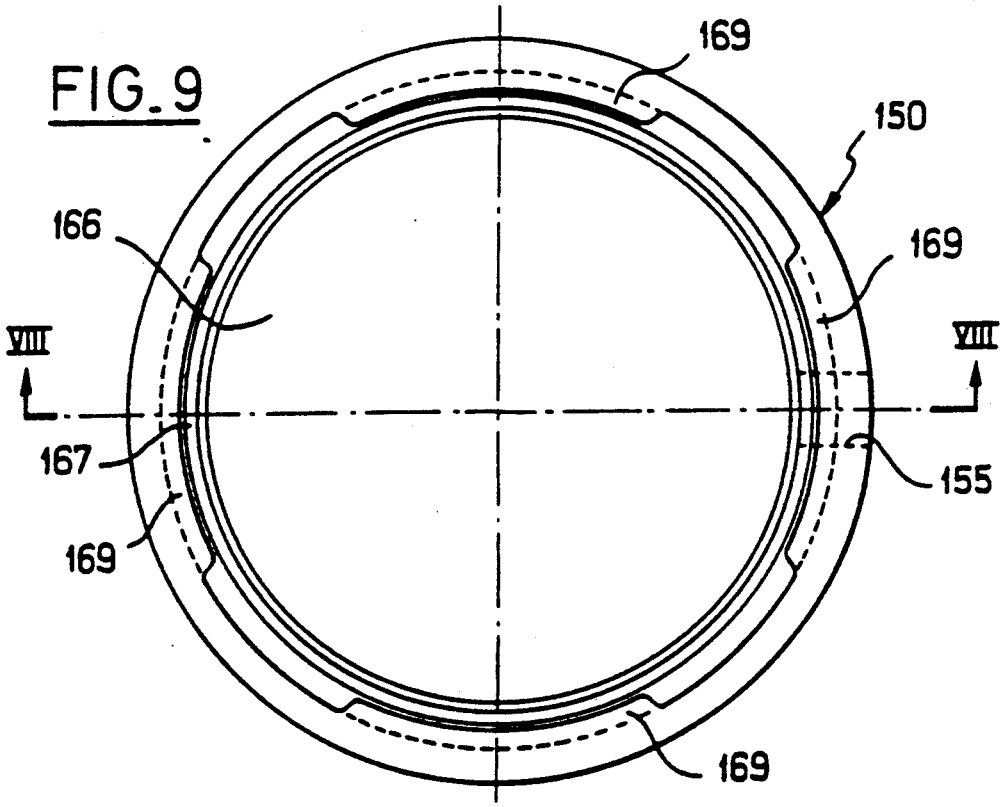
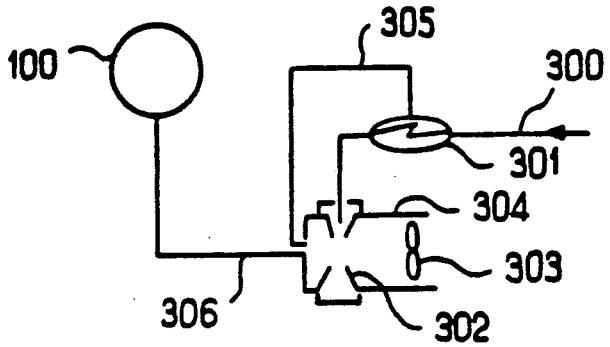
FIG. 10

COOKING ASSEMBLY FOR A COOKER OR A COOKING TOP AND INCLUDING AT LEAST ONE GAS BURNER

The present invention relates to a cooking assembly for a cooker or a cooking top of the type that includes a cooking plate and at least one gas burner that enables a receptacle placed above said gas burner to be heated.

Cooking assemblies have been known for a long time that make use of gas burners, natural gas or LPG, as have the advantages they provide (flexibility, low inertia, adjustments immediately visible), however their drawbacks are also known (presence of a grid in the form of a frame which needs to be cleaned frequently and whose appearance appears to be more and more out-of-date, even as used with a sheet of molded glass in which gas burners are received, as has been done recently, as illustrated in Documents U.S. Pat. No. 3,592,180 and U.S. Pat. No. 3,597,135 for example).

Cooking assemblies have also been known for a long time that use plates with electrical resistances, that do not use any frame-like grid since the receptacles to be heated are placed directly on the hotplates, however their drawbacks are also known (high inertia, adjustments difficult to visualize).

An important change has been provided with the appearance of vitroceramic plates having halogen lamps, since such plates benefit from two considerable advantages, mainly ease of cleaning (the surface of the cooking plate is plane over its entire area) and an external appearance that is clearly new, giving a more modern look.

However, such systems still suffer from limited flexibility, and they require sophisticated design to ensure safety. In addition, it remains necessary to ensure that the vitroceramic plate does not rise to a temperature that is too high, thereby requiring safety devices to be present (temperature sensors and temperature limiters) with the drawback of limiting heating power.

Attempts have also been made to renovate gas cookers by using a vitroceramic cooking plate, as illustrated for example in Document FR-A-2 282 604 and in Document FR-A-2 351 359 which refers back to the other.

Such cooking assemblies are then fitted with radiant burners made of perforated ceramic (the ceramic material used has a cellular structure, possibly a honeycomb structure, and/or includes surface craters enabling combustion flames to be kept down in the cells of the ceramic).

However, the presence of gas burners disposed beneath the plane vitroceramic plate further increases thermal inertia and causes efficiency to be considerably reduced. Under such circumstances, the heat transmitted comes almost solely from radiation: the combustion gases are trapped beneath the vitroceramic plate and must be removed via slots provided at the back of said plate, such that practically no heat is transmitted by convection. The option of transmitting heat by convection is thus almost totally lost, which heat potentially constitutes about two-thirds of the heat energy produced by a gas burner. In addition, it is even more necessary under such circumstances to ensure that the vitroceramic plate is not overheated, thus requiring temperature limiters to be provided between the gas burners and the said plate (it is essential to keep temperature to below about 540° C., thereby also putting a limit on the types of burner that can be used, and in particular preventing direct contact with a naked flame). The confinement of the combustion gases also constitutes a difficulty that is very difficult to overcome, and in any event puts a limit on utilization options: finally, this technique which tends towards an electrical installation does not give rise to performance that is equivalent to that obtained from halogen lamps or induction.

Attempts could have been made to mitigate the above-mentioned drawbacks by placing the perforated ceramic radiant burners no longer beneath the vitroceramic plate as applies in both of the above-mentioned documents, but flush with said plate, the plate being provided with holes associated with said radiant burners in order to allow said burners to act directly. However, such a solution is not practical, in reality, since it is well known that perforated ceramic radiant burners are unsuitable for having their surfaces exposed directly because of their mechanical fragility and because of their vulnerability to thermal shock: any boiled-over liquid or solid would run the risk of damaging (by thermal shock) and/or of clogging up the cellular material, and in addition, any cleaning (by scraping or otherwise) could have the effect of irreversibly spoiling the top face of the perforated ceramic radiant burner, as is, indeed, specifically mentioned in above-specified document FR-A-2 282 604.

An object of the invention is to design a cooking assembly whose design makes it possible to obtain the main advantages of more recent electrical systems that have a cooking plate, while avoiding the drawbacks of the prior art with respect to inertia and safety.

Another object of the invention is to design a cooking assembly enabling a cooking plate made of molded glass, of vitroceramic, or of any other material compatible with technical requirements and with requirements of appearance, such as the recently developed agglomerates of inorganic substances, without running the risk of said plate becoming too hot and without confining the atmosphere beneath it, while nevertheless retaining an external appearance that is satisfactory and good looking.

More particularly, the present invention provides a cooking assembly for a cooker or a cooking top, and comprising a cooking plate and at least one gas burner enabling a receptacle placed above said gas burner to be heated, said cooking plate including an opening associated with said gas burner to enable said gas burner to act directly through said opening when said burner is in use, the assembly being characterized by the fact that at least one of the gas burners is a radiant burner having a metal fiber structure with its top face being essentially plane and flush with the top surface of the cooking plate, said radiant burner being organized so as to close the associated opening.

According to a particularly advantageous feature, the metal fiber structure radiant burner is dismountable for cleaning purposes, with mounting and dismounting of said radiant burner being performed at least in part by rotating said burner.

Several variants may be envisaged, for example:

the metal fiber structure radiant burner is screwed directly to the cooking plate, the associated opening being provided with a thread that corresponds to an outside thread provided on the side of said radiant burner;

the metal fiber structure radiant burner is screwed to the cooking plate by means of an insert, the associated opening then being smooth, and said insert having an inside thread that corresponds to an outside thread provided on the outside of said radiant burner;

the metal fiber structure radiant burner is screwed via its bottom end to a screw well secured to the bottom of said assembly, a sealing ring that withstands high temperature being provided between the associated opening and the adjacent side wall of said radiant burner;

the metal fiber structure radiant burner is connected by means of a bayonet system or by means of a sloping ramp system to a stationary housing disposed beneath the cooking plate coaxially with the associated opening; in which case it is preferable for the stationary housing simultaneously to form an air/gas mixture chamber for the metal fiber structure radiant burner.

It is also advantageous for a helical spring to be associated with the metal fiber structure radiant burner by being compressed when said radiant burner is in an operating position, thereby making it easier to extract said radiant burner when dismounting it.

It is also advantageous to be able to heat a receptacle disposed above the radiant burner without direct contact being made between the bottom of the receptacle and the top face of said radiant burner.

To do this, in a first embodiment, the cooking plate has projections disposed around the opening associated with the metal fiber structure radiant burner for the purpose of supporting the receptacle to be heated over the top face of said radiant burner; in particular, the projections may be corrugations or ridges that are integral with the cooking plate, said cooking plate being preferably made of molded glass or of vitroceramic, or else of a solid material constituted by inorganic substances coated with an organic polymer binder.

In a variant, the top face of the metal fiber structure radiant burner has projections for supporting the receptacle to be heated over said top face.

In which case, the projections may be ridges, ribs, or the like, or else are rounded studs, which rounded studs are integral with the metal fiber structure radiant burner or with the support for said radiant burner, or are applied thereto and are removable.

According to another feature of the invention, the top face of the metal fiber structure radiant burner is constituted by a single piece such that said face constitutes a single radiant surface which is active over its entire area.

In a variant, the top face of the metal fiber structure radiant burner includes a plurality of disjoint radiant of surfaces that are flush with the level of the top face of a common support; in particular, the disjoint of radiant of surfaces are elongate in shape when seen from above, and are preferably disposed parallel to a common direction.

It is then preferable for the common support to close the opening associated with the radiant burner and to cover the edge of said opening, and for it to be connected, preferably by means of a bayonet system, to a stationary housing disposed beneath the cooking plate coaxially with said opening, said stationary housing constituting an air/gas mixture chamber common to all of the disjoint radiant of surfaces.

For example, under such circumstances, the said common support is a metal block, which is preferably externally protected by means of a coating.

Finally, it is preferable for each metal fiber structure radiant burner to be fed with air by means of an associated fan, said air drawing in the gas required for making up the mixture by means of a venturi, the gas being injected through the throat of the venturi.

Other characteristics and advantages of the invention appear more clearly in the light of the following description of various embodiments given with reference to the accompanying drawings, in which.

Figure 3A:
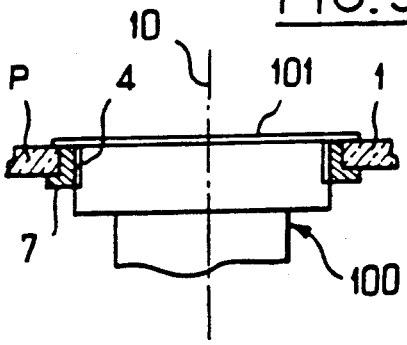
Figure 3B:
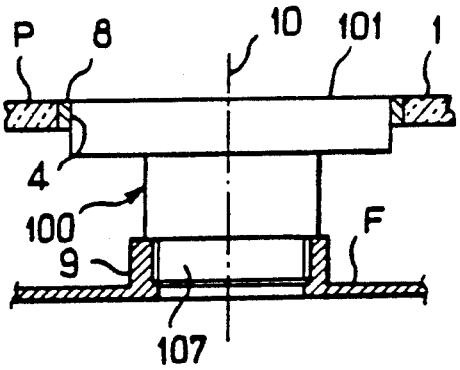
Figure 3C:
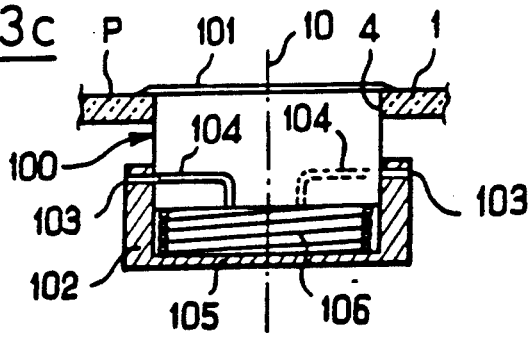
Figure 4:
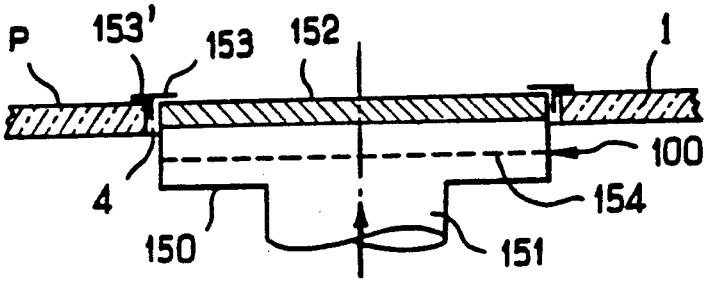
Figure 5:
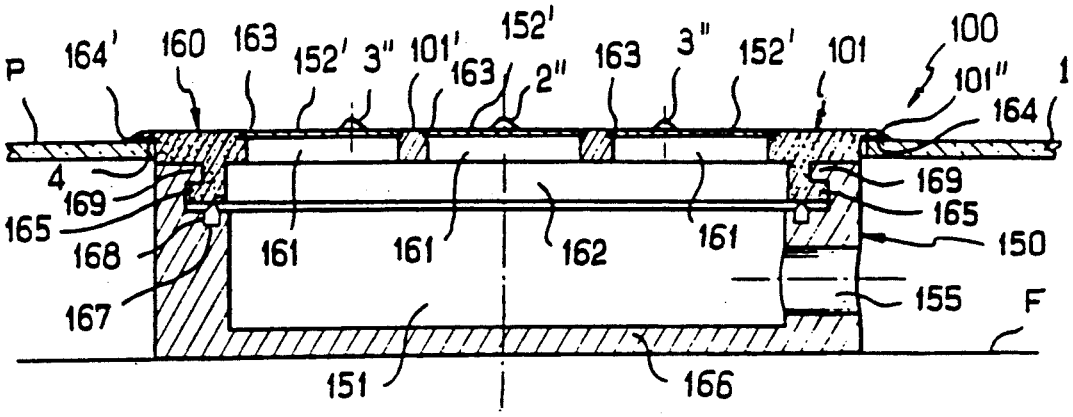
Figure 6:
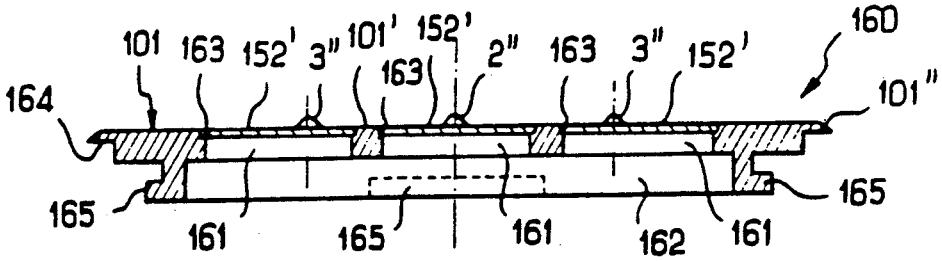
Figure 7:
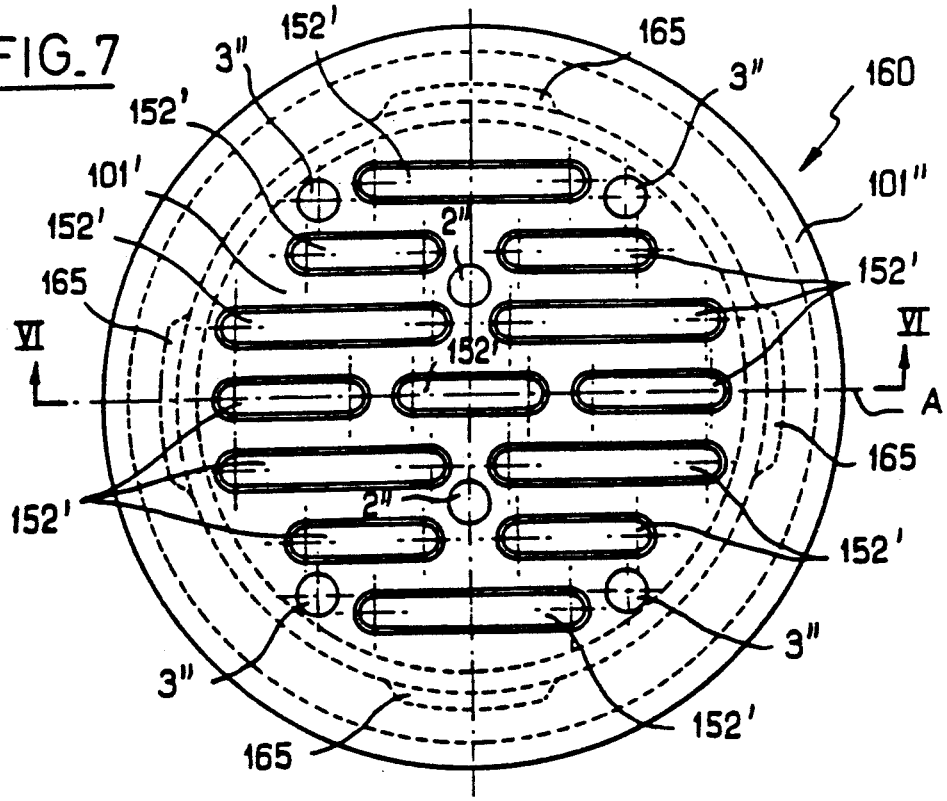

FIGS. 3*a* to 3*c* are on a larger scale and show different particular implementations of the above cooking assembly in which the radiant burner is removable, being screwed to the cooking plate by means of an insert (FIG. 3*a*), being screwed to the bottom of the cooking assembly (FIG. 3*b*), or else being connected by a bayonet system to a stationary housing disposed beneath the cooking plate, with a disengagement spring being interposed (FIG. 3*c*);

FIG. 4 is a more detailed section view through the metal fiber radiant burner assembled to its bottom housing that forms an associated chamber for the air/gas mixture, the top face of said radiant burner being constituted by a single part in this case, thereby constituting a single radiant surface that is active over its entire area;

FIG. 5 is a section through another variant in which the top face of the radiant burner having a metal fiber structure includes a plurality of disjoint radiant surfaces that are flush with the top surface of a common support constituted, for example, by a metal block;

FIG. 6 is a section through the above-specified common support, and FIG. 7 is a plan view of said common support, showing a set of elongate and disjoint radiant surfaces that are thirteen in number in this case (with FIG. 6 being a section on VI—VI of FIG. 7);

FIG. 8 is a section through the burner body associated with the above-specified common support, and FIG. 9 is a plan view of said burner body (FIG. 8 being a section on VIII—VIII of FIG. 9); and FIG. 10 is a diagram showing a preferred way of feeding a radiant burner in a cooking assembly of the invention with air by means of a fan.

The cooking assembly for a cooker or a cooker top described below is of the type comprising a cooking plate and at least one gas burner enabling a receptacle plate above said burner to be heated, said cooking plate including an opening associated with said gas burner to enable said burner to act directly through said opening when the burner is in use.

In accordance with an essential aspect of the present invention, at least one of the gas burners is a radiant burner having a metal fiber structure and having a top face which is essentially plane and flush with the top surface of the cooking plate, said radiant burner being organized so as to close the associated opening.

Figure 1:
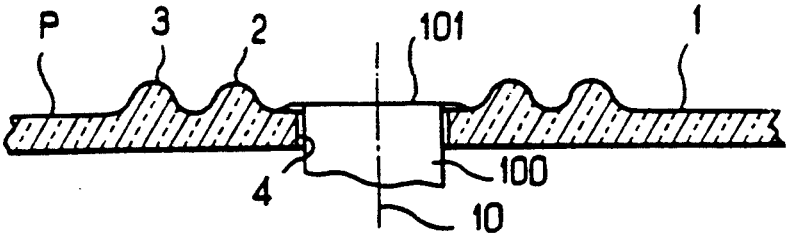
FIG. 1 is a section through a portion of a cooking assembly of the invention having a gas burner in the form of a radiant burner having a metal fiber structure and a cooking plate having projecting ridges around the opening that is closed by the radiant burner, said ridges serving to support a receptacle to be heated (not shown) over the top face of said radiant burner.

Thus, in FIG. 1, there can be seen a cooking plate 1 having an opening 4 associated with a radiant burner 100 having a metal fiber structure and having an essentially plane top face 101 which is flush with the top surface P of the cooking plate 1. The radiant burner 100 thus closes the associated opening 4 in the cooking plate 1. In this case, if it is desired to heat a receptacle without the bottom of the receptacle coming into contact with the top face 101 of the radiant burner 100 having a metal fiber structure, the cooking plate 1 has projections 2 and 3 disposed around the associated opening 4 to support the receptacle to be heated over the top face 101 of the radiant burner 100. The projections 2 and 3 may be corrugations or ridges, or they may be projecting pegs, and they are preferably integral with the cooking plate 1, which plate is advantageously made of molded glass or of vitroceramic, or else of a solid material constituted by inorganic substances coated with an organic polymer binder such as the material sold under the trademark CORIAN® by Du Pont de Nemours.

Figure 2:
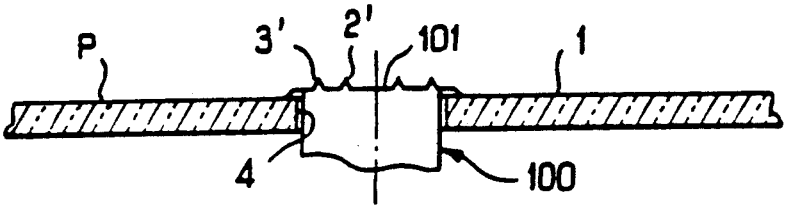
FIG. 2 shows a variant of the preceding embodiment in which the projections (e.g. the ridges) are provided on the top face of the radiant burner having a metal fiber structure, in which case the cooking plate around the associated opening can be plane.

These projections may, in a variant, be provided on the radiant burner itself, thereby making it possible firstly to keep to a cooking plate that is plane, and therefore easier to manufacture from molded glass, form vitroceramic, or from an agglomerated material of inorganic substances, and secondly making it possible to use small receptacles on large-diameter burners. Such a variant is shown in FIG. 2 where there can be seen projections 2' and 3' projecting above the top face 101 of the radiant burner 100, which projections may be corrugations, ridges, or ribs that are radial or otherwise, or they can be projecting pegs or rounded studs which are preferably integral with the top portion of the radiant burner, but which could also be applied thereto and removable. An embodiment with rounded studs is described below with reference to FIGS. 5 and 6.

When the radiant burner 100 of metal fiber structure is used, the above-mentioned gas advantages are retained, and in particular the entire benefit of convection for heat transfer purposes. When the radiant burner is not in use, the top face of the burner which is flush with the top surface P of the cooking plate 1 forms a closure lid so that the top surface of said cooking plate is continuous with each of the corresponding openings 4 being completely masked, thereby ensuring that the external appearance of the cooking assembly is that of a single cooking plate, thereby making it easier to clean, as applies to vitroceramic cooking plates in known cooking assemblies. As explained above, receptacles are held higher than the surface of the cooking plate, thereby making it possible to evacuate combustion products, with evacuation taking place in this case to the ambient atmosphere, in contrast to known solutions that use perforated ceramic gas burners that heat a vitroceramic cooking plate directly, thereby giving rise to a confined atmosphere beneath said cooking plate. In practice, the projections may be a few millimeters tall so as to avoid spoiling the uniform appearance of the top face of the cooking plate or of the radiant burner, as the case may be, and the projections may have a wide range of shapes, so long as they do not serve to direct liquid that has boiled over towards said radiant burner. In general, rounded shapes are preferred, such as the shapes shown in FIGS. 1 and 2, using large radiuses of curvature, thereby making it easier to clean the cooking plate or the radiant burner.

If liquid should boil over onto a burner that is in use, the flame will cause water to evaporate and any organic substances that may be present in the water will be burnt (automatic cleaning by pyrolysis). However, if liquid should boil over onto a radiant burner that is not in use, then the liquid will dirty the top face of the burner. Under such circumstances, it can be advantageous to be able to dismantle the burner so as to make it easier to wash (or possibly to replace). The metal fiber structure radiant burner 100 is therefore preferably dismountable and it should be mounted and dismounted at least in part by being rotated.

The metal fiber structure radiant burner 100 may be screwed directly to the cooking plate 1, in which case the associated opening 4 has a thread corresponding to an outside thread provided on said radiant burner. Nevertheless, such a solution (not shown herein) is difficult to implement in that it is difficult to obtain such a thread on a plate made of a material such as vitroceramic: it is therefore preferable to use one of the solutions shown in FIGS. 3*a* to 3*c*.

In FIG. 3*a*, the radiant burner 100 is screwed onto the cooking plate 1 by means of an insert 7. The insert 7 may be made of metal or of ceramic, or of any other appropriate material, and it is molded on or stuck to the cooking plate 1. In this case it is in the form of an L-section ring having an inside thread that corresponds to an outside thread provided on the radiant burner 100: the associated opening 4 then has a smooth edge and there is no need to provide the cooking plate with a thread in said opening.

In FIG. 3*b*, the radiant burner 100 has a downwards extension 107 having an outside thread for screwing into a tapped well 9 secured to the bottom (F) of the cooking assembly: this provides the same advantage as above insofar as the edge of the opening 4 can be smooth. If necessary, it may be advantageous to provide a gasket 8 of material that withstands high temperatures in order to improve sealing when the radiant burner is put into its operating position by being screwed therein.

In FIG. 3*c*, although the radiant burner 100 can be connected by means of a bayonet system or a system having a sloping ramp to a separate part which is disposed beneath the cooking plate 1 coaxially with the axis 10 of the associated opening 4, the illustrated burner 100 is received in a stationary housing 102 having inwardly projecting lugs 103 which are received in associated slots 104 formed in the periphery of the radiating burner 100. The stationary housing 102 is stationary with respect to the table top P. The slots 104 are essentially horizontal (in part) suitable for a bayonet type connection, such that it is advantageous to provide a helical spring 106 received between the bottom 105 of the stationary housing 102 and the bottom portion of the radiant burner 100, said spring being compressed when said radiant burner is mounted in its operating position. As a result, merely by imparting a small amount of rotation to the burner 100, the lugs 103 can be brought into the vertical portion of the slots 104, whereupon the helical spring 106 causes the radiant burner 100 to pop out, thereby making it considerably easier to take hold of the burner when it is desired to dismount it for cleaning or replacement purposes.

As explained below, the above-specified stationary housing may advantageously simultaneously for the air/gas mixture chamber of the metal fiber structure radiant burner 100.

These various solutions are particularly simple and they satisfy esthetic requirements that go against any sharp edges that could be used as holds for disassembly purposes, while nevertheless avoiding the need to provide additional openings through which boiling-over liquid could penetrate. Locking in the operating position may be obtained by snap-fastening or by a ball-system or by any equivalent means (not shown).

Above-described FIGS. 1 to 3c show how metal fiber structure radiant burners can be installed in a cooking plate, and how they can be fixed therein (possibly with an option for being removed therefrom), while the structure per se of the active portion of the radiant burners is shown diagrammatically only.

The structure of the metal structure radiant burners used in the context of the present invention is described below in greater detail.

It should firstly be observed that metal fiber radiant burners are highly advantageous in that a major portion of the energy (20% to 30%) is transmitted directly in radiant form, thereby improving the cooking efficiency of such burners, and insofar as their mechanical strength is very high (particularly if the fibers are sintered), thereby enabling them to withstand thermal shock (in the event of a liquid or a solid boiling over) and domestic cleaning (by abrasion or otherwise), unlike the above-mentioned perforated ceramic gas burners. In addition, the metal fiber material has very low thermal inertia because of the conductivity of the fibers and because of its high degree of porosity. The quantity of heat it accumulates is low and it is very easily restored. To obtain the full benefit of this advantage, it is nevertheless appropriate for the entire area in contact with the combustion products to have the same quality: an insulating coating that withstands high temperatures may then constitute a solution that is acceptable when the fiber material does not cover the entire area of the burner. It is also important to ensure that thermal bridges are avoided so as to prevent unfavorable conduction between the combustion surface and the combustion chamber: provision may thus be made for additional thermal protection at the periphery which is compressed for the purpose of securing the burner, and provision may possibly also be made to provide upstream protection on those regions of the burner that are not covered in fiber material.

Such metal fiber burners may operate either in radiant mode (surface combustion raising the fibers on the surface to incandescence) or else in blue flame mode when the flow speed of the air-gas mixture through the porous medium becomes greater than the flame propagation speed of the same mixture. To obtain this mode of operation, the power that the burners can accept per unit area may be increased, or else the propagation speed can be reduced by changing the air/gas ratio. In radiant mode, such burners give off little NOx oxide (20 ppm to 40 ppm in stoichiometric combustion, compared with 200 ppm to 400 ppm in a conventional burner).

For example, metal fibers may be used that are made on the basis of a material sold under the trademark FECRALLOY® having a diameter of 22 microns and a length of 4 mm, which fibers are disposed in random parallel to a support plane and are then compressed and sintered in order to provide a material whose porosity lies in the range 80% to 85% with extremely small variation in porosity. In a variant, it is possible to use other refractory alloys or certain equivalent ceramic fibers for the purpose of making the fiber material. The finished material is then in the form of a layer whose thickness lies in the range 1 mm to 4 mm, with a thickness of 2 mm presenting a cost/performance compromise that gives full satisfaction.

Reference may also be made to Document EP-A-0 157 432, in which a porous metal fiber material is described that is particularly well adapted to making a gas burner of the above-mentioned type. Such a fiber material makes it possible to provide burners having a high degree of flexibility in adjustment (ratio between maximum power and minimum power greater than four).

FIG. 4 also shows a detail of a metal fiber structure radiant burner 100 which includes a burner body 150 supporting a thickness of fiber material in the form of a plate 152 closing the air-gas mixture chamber 151. The metal fiber layer 152 is fixed to the body 150 by any appropriate means, represented herein by a crimping ring 153 which has a T-shaped section in the present case, with one flange overlying the edge of the opening 4 in the cooking plate 1 via an interposed flat gasket 153', e.g. made of silicone, guaranteeing the required flexibility for mounting with complete fluid tightness against liquid that boils over. In a variant, it would be possible to use compression by screwing on a cover, by gluing using a ceramic glue, by riveting, by stapling, or by screwing. It may also be advantageous to provide a device for homogenizing and distributing the air-gas mixture, represented in this case by a mesh 154, thereby enabling the entire rear face of the plate of fiber material 152 to be fed uniformly and avoiding the formation of preferred paths.

It is also possible to modulate the heating areas of the radiant burners used as a function of the powers and the sizes of said burners.

The radiant burner described above with reference to FIG. 4 has a one-piece top face 101 (plate 152) such that said face constitutes a single radiant surface that is active over its entire area.

It may nevertheless turn out to be advantageous to split up the radiant surface and to use a plurality of disjoint, smaller radiant surfaces each forming a burner subassembly, as shown in FIGS. 5 to 7, with FIGS. 8 and 9 showing the associated burner body.

These figures show a metal fiber structure radiant burner 100 whose top face 101 includes a plurality of disjoint radiant surfaces separated by small plates 152' (thirteen such plates in this case) that are flush with the top face 101' of a common support 160.

The bottom of the common support 160 has a projecting edge 165 enabling bayonet type assembly on the burner body 150 by co-operating with corresponding projections 169 on said body. A peripheral groove 167 is provided on the burner body 150 to receive a sealing ring 168 which serves not only to seal the gas in the chamber 151, but also to accommodate clearance in the bayonet coupling connection (the sealing ring 168 is slightly compressed on assembly so as to retain a spring effect ensuring that such clearance is taken up). The burner body 150 is made of metal or of a plastic that is compatible with the material of the common support (which compatibility must be both thermal and mechanical to enable relative sliding), and its bottom 166 rests on the bottom F of the cooking assembly, optionally with a thin fiber cushion (not shown) being interposed to provide thermal insulation and possibly also to contribute to taking up clearances. The burner body 150 simultaneously defines the air/gas mixture chamber 151 of the radiant burner, which mixture arrives via a lateral inlet 155, said chamber communicating directly with a bottom central space 162 of the common support 160 into which elongate openings 161 formed through the top wall of said common support open out. The tops of these elongate openings 161 have respective shoulders 163 enabling the plates 152' of metal fiber material to be supported, which fibers are preferably sintered in order to increase the mechanical strength of said plates. The plates 152' are thus flush with the essentially plane top face 101' of the common support 160, which top face is radially extended by a slightly curved peripheral edge 101" that overlies the edge of the opening 4 through the cooking plate 1. As can be seen in FIG. 5, the common support 160 bears against the cooking plate 1 via the bottom face 164 of its peripheral edge 101", with a flat gasket 164' (preferably made of silicone) being interposed both to guarantee good sealing against liquids that boil over and to provide flexibility for taking up clearance.

With this disposition, the air/gas mixture arriving via the inlet duct 155 penetrates into the chamber 151 which is thus common to all of the disjoint radiant surfaces 152'.

As can be seen more clearly in FIG. 7, the disjoint radiant surfaces 152' are elongate in shape when seen from above and they are preferably disposed parallel to a common direction A. However, it will naturally be understood that other shapes and/or dispositions of the disjoint radiant surfaces could be used.

For example, the common support 160 may be constituted by a metal block, advantageously provided with an outer protective coating.

It may also be observed that rounded studs 2" and 3" are present on the top face of the common support 160, with there being two central studs 2" and four peripheral studs 3" in this case, thereby enabling a receptacle to be heated to be held a few millimeters above the common support, with the rounded studs being integral therewith, in this case. In a variant, the rounded studs could be added on and they could be removable.

By way of example, using a common circular support having an outside diameter of about 190 mm, the plates 152' may be about 40 mm to 60 mm long, they may be about 8 mm to 10 mm wide, and they may be about 2 mm thick, with the rounded studs projecting 5 mm to 8 mm above the plane of the top face of the radiant burner.

FIG. 10 is a diagram showing an advantageous way of feeding the radiant burner of the cooking assembly of the invention.

There can be seen a gas feed duct 300 fitted with an expander 301 and opening out into a venturi 302. Air is fed via a duct 304 including a fan 303. Each radiant burner 100 is thus fed with air by means of an associated fan 303, and the air draws in the gas required for making up the mixture by means of the associated venturi 302, with the gas being fed in through the throat thereof. The gas pressure is adjusted by the associated expander 301 which is preferably controlled via a feedback loop 305 from the pressure of the air-gas mixture which is finally delivered by the duct 306 to the radiant burner 100. The fan 303 may be controlled to vary the air flow rate and thus to vary the power of the burner by means of an associated dimmer-type circuit: this makes it possible to eliminate electrical or electromechanical actuators and to fit the cooking assembly with touch-sensitive controls.

The invention is not limited to the embodiments described above, but on the contrary it covers any variant that may use equivalent means to reproduce the essential characteristics mentioned above.

We claim:

1. A cooking assembly for a cooker or a cooking top, comprising a cooking plate and at least one gas burner enabling a receptacle placed above said gas burner to be heated, said cooking plate including an opening associated with said gas burner to enable said gas burner to act directly through said opening when said burner is in use, at least one of the gas burners is a radiant burner having a metal fiber structure with its top face being essentially plane and flush with the top surface of the cooking plate, said radiant burner being organized so as to close the associated opening, the top face of the metal fiber structure radiant burner including a plurality of disjoint radiant surfaces that are flush with the level of the top face of a common support.

2. A cooking assembly according to claim 1, wherein the metal fiber structure radiant burner is dismountable for cleaning purposes, with mounting and dismounting of said radiant burner being performed at least in part by means for rotating said burner.

3. A cooking assembly according to claim 2, wherein the metal fiber structure radiant burner is connected by means of a bayonet system or by means of a sloping ramp system to a stationary housing disposed beneath the cooking plate coaxially with the associated opening.

4. A cooking assembly according to claim 3, wherein the stationary housing simultaneously forms an air/gas mixture chamber for the metal fiber structure radiant burner.

5. A cooking assembly according to claim 1, wherein the top face of the metal fiber structure radiant burner has projections for supporting the receptacle to be heated over said top face.

6. A cooking assembly according to claim 5, wherein the projections are rounded studs.

7. A cooking assembly according to claim 6, wherein the rounded studs are integral with the metal fiber structure radiant burner or with a support for said radiant burner.

8. A cooking assembly according to claim 6, wherein the rounded studs are added on and are removable.

9. A cooking assembly according to claim 1, wherein the disjoint radiant surfaces are elongate in shape when seen from above, and are preferably disposed parallel to a common direction.

10. A cooking assembly according to claim 1, wherein the common support closes the opening associated with the radiant burner and covers the edge of said opening, and is connected, by means of a bayonet system, to a stationary housing disposed beneath the cooking plate coaxially with said opening, said stationary housing constituting an air/gas mixture chamber common to all the disjoint radiant surfaces.

11. A cooking assembly according to claim 10, wherein the common support is a metal block, which is externally protected by means of a coating.

12. A cooking assembly according to claim 1, wherein each metal fiber structure radiant burner is fed with air by means of an associated fan, said air drawing in the gas required for making up the mixture by means of a venturi, the gas being injected through the throat of the venturi.

* * * * *